US005632176A

United States Patent [19]

Bhandari

[11] Patent Number: 5,632,176

[45] Date of Patent: May 27, 1997

[54] PROGRAMMABLE PRESSURE CONTROLLED MANDREL EXTRACTOR FOR TUBE BENDING MACHINE

[75] Inventor: Ajay K. Bhandari, Westlake, Ohio

[73] Assignee: Pines Manufacturing, Westlake, Ohio

[21] Appl. No.: 540,065

[22] Filed: Oct. 6, 1995

[51] Int. Cl.[6] ..... B21D 9/05; B21D 7/04

[52] U.S. Cl. ..... 72/150; 72/149

[58] Field of Search ..... 72/149, 150, 20.1, 72/21.3, 17.3, 155

[56] References Cited

U.S. PATENT DOCUMENTS

| | | |
|---|---|---|
| 4,331,015 | 5/1982 | Benteler et al. . |
| 4,481,803 | 11/1984 | Dieser . |
| 4,538,436 | 9/1985 | Schwarze . |
| 4,744,233 | 5/1988 | Trudell . |
| 4,959,984 | 10/1990 | Trudell et al. . |

*Primary Examiner*—Lowell A. Larson
*Assistant Examiner*—Rodney A. Butler
*Attorney, Agent, or Firm*—Pearne, Gordon, McCoy & Granger LLP

[57] ABSTRACT

A tube bending machine is provided which includes a rotatable bend die about which the tube is bent, a mandrel insertable into the tube adjacent the bend, and a mandrel rod fixed to a rear end of the mandrel. A mandrel extractor system is also included which linearly advances and retracts the mandrel. The mandrel extractor system includes a linear actuator connected to the mandrel rod and an electro-hydraulic control system which automatically drives the linear actuator at variable pressures. The linear actuator includes a hydraulic cylinder with a piston connected to the mandrel rod. The electro-hydraulic control system includes a hydraulic pump which provides hydraulic fluid to the cylinder, a directional valve which selectively feeds the hydraulic fluid to opposite sides of the piston, a proportional pressure control valve which varies pressure of the hydraulic fluid, and a microprocessor based controller in electrical communication with the valves which provides control signals to vary the pressure of the hydraulic fluid. The controller is pre-programmed with several preselected pressure levels for the mandrel extractor. The tube is loaded over the mandrel while the mandrel is at a system pressure. The mandrel is moved within the tube at a very low pressure, below that of the system pressure, to the tangent point of the tube and the bend die. After reaching the tangent point, the mandrel pressure is increased back to the system pressure. During the bending operation, the mandrel pressure can be maintained at the system pressure or varied. At the end of the bend operation, the pressure is increased to a level above the system pressure to pull the mandrel out of the tube.

20 Claims, 4 Drawing Sheets

PROGRAMMABLE PRESSURE CONTROLLED MANDREL EXTRACTOR FOR TUBE BENDING MACHINE

BACKGROUND OF THE INVENTION

1. Field of the Invention

The present invention relates generally to a mandrel extractor system for a mandrel of a tube bending machine, and more particularly, to a mandrel extractor system which advances and retracts the mandrel at pre-programmed pressure levels.

2. Description of Related Art

Tube bending machines are well-known in the art. In one common type of machine, a tube is secured between a bend die and a clamp die which rotate together, drawing the lead portion of the tube therewith to bend it around the bend die. A pressure die engages an outside wall of the trailing portion of the tube to counter the reaction force of the tube during the bending operation.

Some machines place a mandrel within the tube so that as the tube is drawn over the mandrel as the tube is being bent (i.e. as the bend and clamp dies are rotated) the mandrel helps maintain proper cross-sectional configuration of the tube throughout the bend. Mandrels are particularly important in bending relatively thin walled tubes. Some mandrels are flexible, such as having multiple balls linked together, so that the mandrel can be extended beyond the tangent point of the tube and the bend die to still further ensure maintenance of the proper cross-sectional configuration of the tube throughout the bend.

The mandrel is typically connected by a mandrel rod to a mandrel extractor which is mounted at the end of the machine bed. The mandrel rod is moved back and forth by the hydraulic mandrel extractor to push the mandrel inside the tube during a bend operation and to extract the mandrel from the tube after the bend operation. Conventional mandrel extractors drive and extract the mandrel under constant pressure, and typically at a high system pressure of the tube bending machine. One problem with a constant pressure system, however, is safety of operating personnel. When the mandrel is pushed at a relatively high system pressure, the long thin mandrel rod can buckle and ultimately break. Striking any obstruction while moving the mandrel rod at a high pressure can cause the rod to jam and break and possibly swing around at a high force. Another problem with constant pressure systems is that the mandrel often cannot be extracted from the tube after the bending operation because the pressure is not high enough. Accordingly, there is a need in the art for an improved mandrel extractor which reduces breakage of mandrel rods and/or improves removal of the mandrel from the tube after the bending operation.

SUMMARY OF THE INVENTION

The present invention provides a tube bending machine which overcomes at least some of the above-noted problems of the related art. The tube bending machine includes a rotatable bend die about which the tube is bent and a mandrel insertable into the tube adjacent the bend. A mandrel rod is fixed to a rear end of the mandrel. The tube bending machine also includes a mandrel extractor system for linearly advancing and retracting the mandrel. The mandrel extractor system includes a linear actuator connected to the mandrel rod and an electro-hydraulic control system which automatically drives the linear actuator at variable pressures.

The controller can be pre-programmed with a plurality preselected pressure levels for the mandrel extractor. Preferably, the mandrel is moved forward at a very low pressure, below that of a system pressure, to a tangent point of the bend die. After reaching the tangent point, the mandrel pressure is increased back to the system pressure and the tube is loaded over the mandrel. During the bending operation, the mandrel pressure can be maintained at the system pressure or varied according to a pre-programmed profile. At the end of the bend operation, the pressure is increased to a level above the system pressure to pull the mandrel out of the tube.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
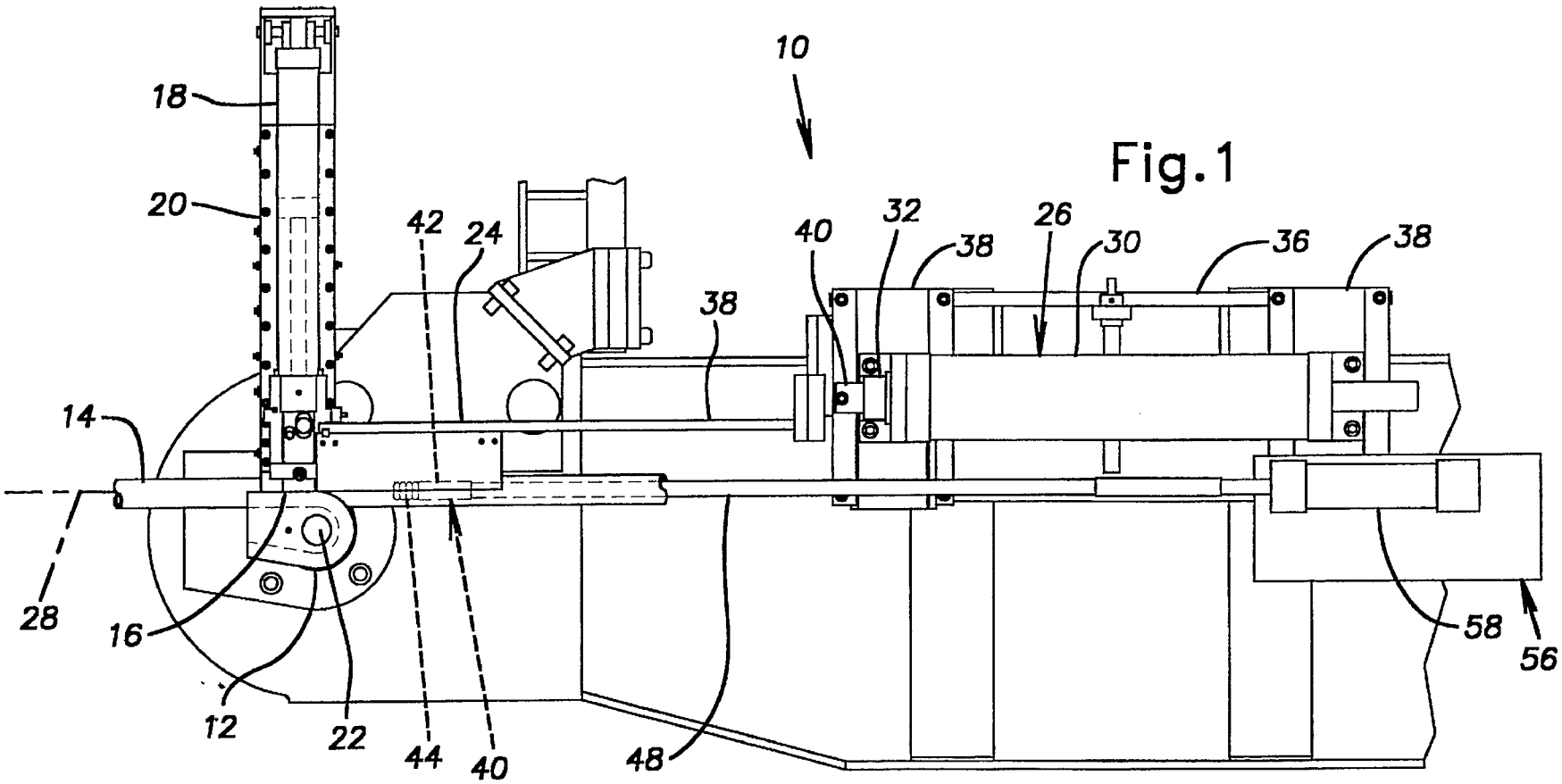
FIG. 1 is a top plan view of a tube bending machine according to the invention.
Figure 2:
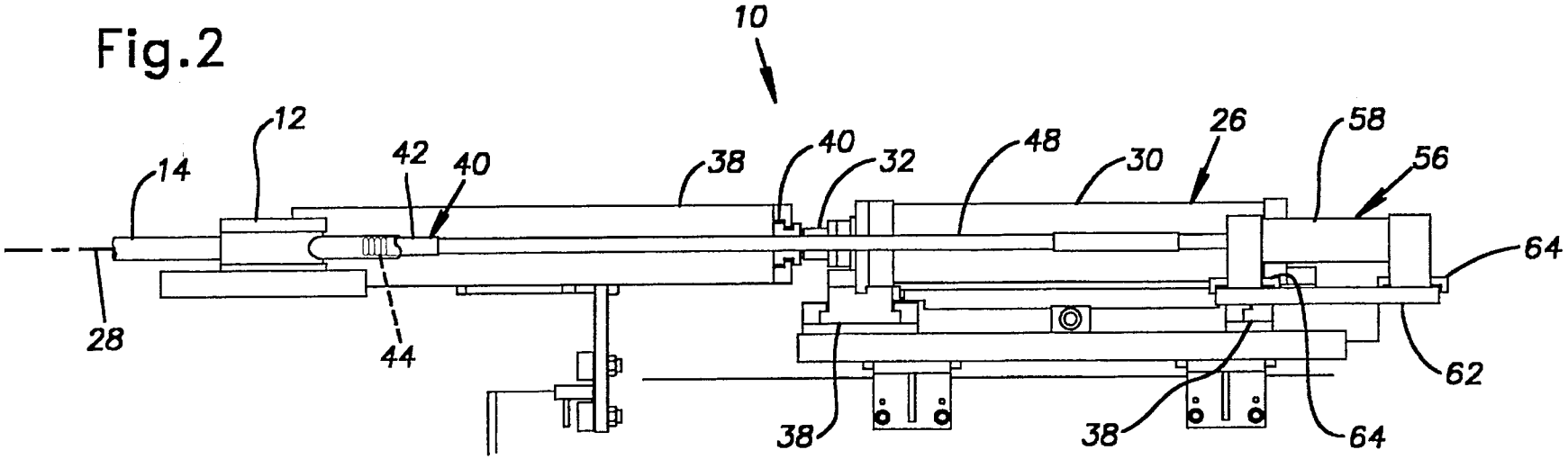
FIG. 2 is a side elevational view of a mandrel extractor of the tube bending machine of FIG. 1.

FIG. 1 illustrates a tube bending machine 10 having a bend die 12 around which a tube 14 is formed. The tube 14 is held against the bend die 12 during a bending operation by a clamp die 16 which is advanced and retracted by an actuator 18 before and after the bending operation respectively. The bend die 12 is attached to a bend or swing arm 20 which is mounted for rotational movement about one end of the tube bending machine 10. The swing arm 20 also houses the clamp die 16 and actuator 18. The swing arm 20 is rotated about a vertical rotational axis 22 by a drive system (not shown) which includes an encoder 23 (FIG. 5) which electronically encodes the angular position of the swing arm 20 to provide the angular position of the bend die 12 at all times during the bend operation.

The tube 14 is also held against the bend die 12 by a pressure die 24 which counters the reaction force of the tube 14 during the bending operation. A pressure die assist boost system 26 is provided to horizontally move the pressure die 24 parallel to a longitudinal axis 28 of the tube 14 and tangent to the bend. The forward movement of the pressure die 24 boosts the forward motion of the outside wall of the tube 14 during bending.

The pressure die assist boost system 26 includes a high pressure hydraulic cylinder 30 having a plunger or pusher 32. The cylinder 30 is mounted such that the pusher 32 travels parallel to the longitudinal axis 28 of the tube 14. The cylinder 30 is mounted to a base assembly 36 by a pair of slides 38 oriented such that the cylinder 30 can horizontally travel in a transverse direction, that is, travel in a direction perpendicular to the direction of travel of the pusher 32. The pressure die 24 is attached to an end of an elongated rectangular plate or master bar 38 which is attached at the other end to the pusher 32 by a gib assembly 40.

The bending machine 10 also includes a flexible mandrel 42 which is inserted into the tube 14 and includes a mandrel head 44 and multiple mandrel balls 46. The forward end of the mandrel head 44 is generally aligned with the tangent point of the tube 14 and bend die 12. More particularly the mandrel 42 is disposed substantially at the portion of the tube 14 being bent to prevent inward collapsing of the tube 14 in response to the bending forces. A mandrel rod 48 extends rearwardly from the mandrel head 44 and is secured by suitable means to fix the position of the mandrel 42 during a bending operation.

Figure 6:
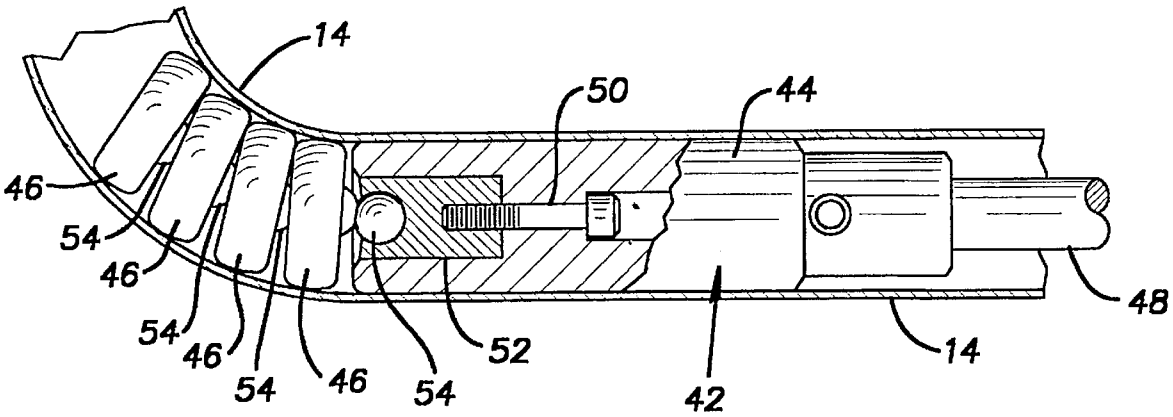
FIG. 6 is a plan view in partial cross-section of a flexible mandrel in the bend of a tube.
Figure 3:
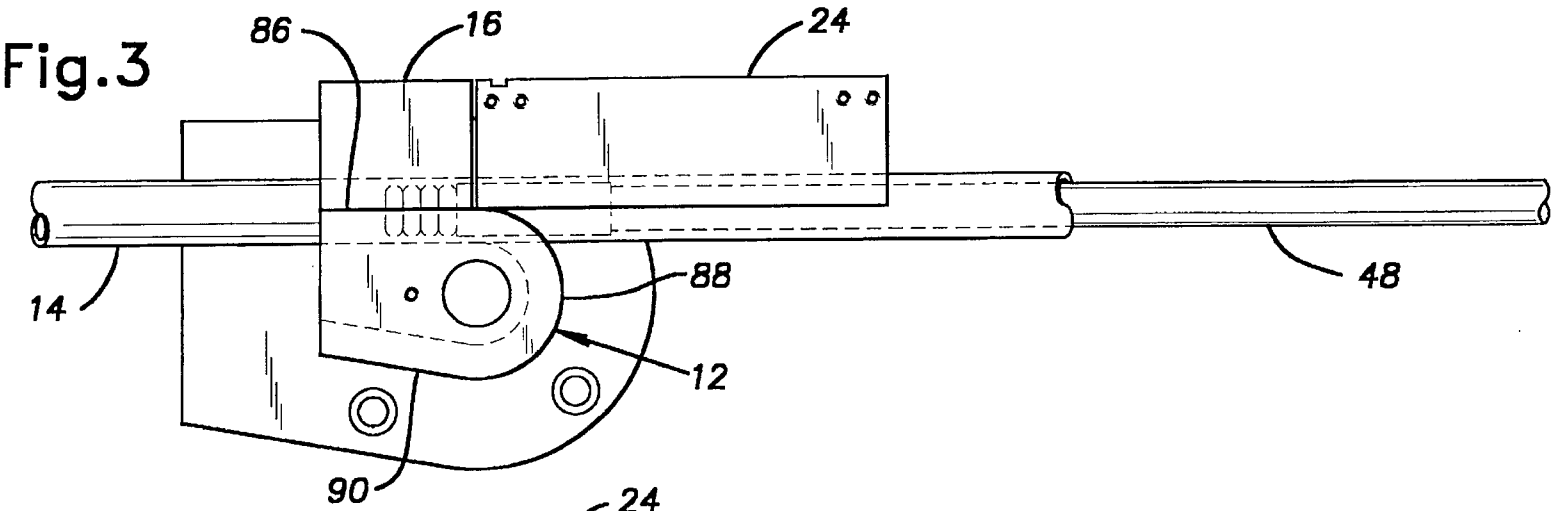
FIG. 3 is a top plan view illustrating the interrelationship between the bend die, the clamp die, the pressure die, and the mandrel at the initiation of a bend.

A typical flexible mandrel 42 is illustrated more fully in FIG. 6 including the mandrel head 44 fixed at its rear end to the mandrel rod 48. Mounted by a bolt 50 to the forward end of the mandrel head 44 is a mandrel link 52 connected to a ball link 54 in a ball and socket-type arrangement, thereby flexibly linking the mandrel balls 46 to the mandrel head 44. Any desired number of mandrel balls 46 may be serially attached in a similar manner, with the illustrated mandrel 42 having four. Other types of flexible mandrels such as, for example, a link and pin mandrel, a cable mandrel, or any other suitable mandrel may be used within the scope of the present invention.

A mandrel extractor system 56 is provided to horizontally move the mandrel along the longitudinal axis 28 of the tube 14 and tangent to the bend. The mandrel extractor system 56 includes a high pressure hydraulic cylinder 58 having a piston 60 (FIG. 5) connected to a rear end of the mandrel rod 48. The cylinder 58 is mounted such that the mandrel rod 48 travels along the longitudinal axis 28 of the tube 14. The cylinder 58 is mounted to a base assembly 62 by a pair of slides 64 oriented such that the cylinder 58 can horizontally travel in a transverse direction, that is, travel in a direction perpendicular to the direction of travel of the mandrel rod 48.

Figure 5:
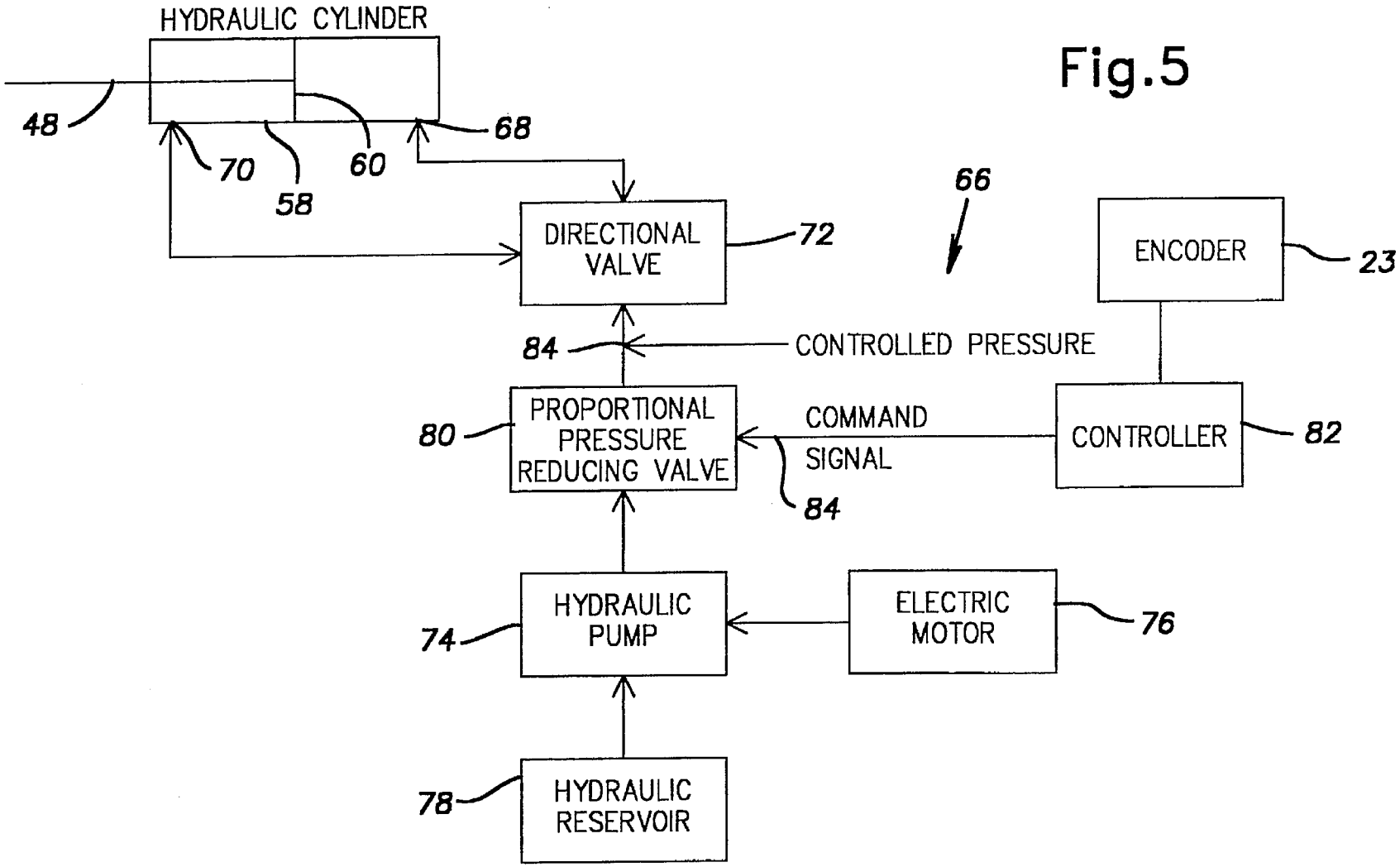
FIG. 5 is a functional block diagram of an electro-hydraulic control system for the mandrel extractor.

The mandrel extractor system 56 also includes a programmable electro-hydraulic control system 66 as diagrammatically illustrated in FIG. 5. The control system 66 is an open-loop type system in that, while movement of the mandrel 40 is controlled, no feed-back is provided as to the actual movement of the mandrel 40. The cylinder 58 includes ports 68, 70 for receiving hydraulic fluid under pressure on opposed sides of the piston 60. The fluid ports 68, 70 are connected to a directional valve 72 which directs hydraulic fluid to and from the ports 68, 70 of the cylinder 58. The directional valve 72 of the preferred embodiment is available from the Parker Corporation, part no. 2CBB2HLT14AC10. The hydraulic fluid is supplied from a variable displacement pressure compensated hydraulic pump 74 which is driven by an electric motor 76. The hydraulic pump 74 of the preferred embodiment is rated at 20 GPM and 0–2000 psi, and the motor 76 is rated at 30 hp and 1800 rpm. Preferably, the pump 74 is a separate from any pump used for other control systems within the tube bending machine 10 so that its full capacity is available for driving the cylinder 58. The hydraulic pump 74 is connected to a reservoir of hydraulic fluid 78.

The directional valve 72 is connected to the hydraulic pump 74 with a proportional pressure reducing valve 80. The proportional pressure reducing valve 80 of the preferred embodiment is available from the Parker Corporation, part no. T-30475. The proportional pressure reducing valve 80 operates with a command signal which ranges from 0–10 volts dc. The proportional pressure reducing valve operates linearly except at a low end of the range where a command signal of 0 volts dc obtains a minimum pressure, such as 200 psi, and a command signal of 10 volts dc obtains full pressure. Preferably, the valve 80 is capable of controlling pressures up to 3,000 psi.

A microprocessor based controller 82 supplies control signals 84 to the proportional pressure reducing valve 80. Additionally, a constant system pressure, typically about 100 psi, is input at a point 84 between the directional valve 72 and the proportional pressure reducing valve 80. Software for the controller 82 allows the operator to pre-program the controller by imputing data such as a plurality of pressure settings for the proportional pressure reducing valve 80. Preferably, at least three pressure settings are input, a first or low pressure for advancing the mandrel 40, a second or normal pressure higher than the first pressure and generally equal to the system pressure of the tube bending machine 10 for the bending operation, and a third or high pressure higher than the second pressure for extracting the mandrel 40 from the tube 14. Each of the pressure settings are preferably input as a percentage of a maximum pressure of the electro-hydraulic system 66, however, they can alternatively be input in units of psi. The optimal pressure settings for a bending operation are determined by trial and error.

At the start of a bending operation, the bend die 12 is positioned with a clamp section 86 in alignment with the mandrel 42. The mandrel 40 is moved forward until the forward end of the mandrel head 44 is positioned generally aligned with the tangent point of the tube 14 and bend die 12. The mandrel 40 is preferably moved forward at a very low pressure, lower than the system pressure, so that if there are any obstructions, such as the back of the bend die 12, a wiper die, or mandrel balls 46 which have been dropped, forward movement of the mandrel 40 will be stopped without buckling and breaking the mandrel rod 48. This very low pressure is preferably the minimum force required to move the mandrel rod 48 which can be provided by the control system 66. If the mandrel 40 does not fully advance within a predetermined time limit, forward advancement of the mandrel 40 is stopped. Preferably, the controller 82 shuts-off power to the hydraulic pump 74, however, the controller 82 could alternatively reverse the direction of the mandrel 40. The tube 14 is loaded over the mandrel 40 with a desired location for the forward end of the bend located at the forward tangent point of the bend die 12, that is, located at the beginning of a bending section 88 of the bend die 12. During loading of the tube 14, the mandrel extractor system 56 is preferably at a pressure generally equal to the system pressure. The tube 14 is then. clamped between the bend die 12 and the clamp die 16. The pressure die 24 is moved into abutting relation to the end of the clamp die 16 such that the leading end of the pressure die is positioned at the transition into the bend section 88 of the bend die 12.

The bend die 12 and the clamp die 16 are then rotated by the swing arm 20 at a constant rate of speed such as, for example, 5 to 6 rpm drawing the tube 14 over the mandrel 42 and through the pressure die 24 and bend die 12 and bending the tube 14. Simultaneously, the pressure die 24 is advanced by the pressure die assist boost system 26 in a linear direction to maintain bending pressure on the tube 14 as the bend die 12 is rotated if the pressure die assist boost system 26 is enabled. During rotation of the bend die 12 and the clamp die 16, the mandrel 40 is either maintained at a constant pressure generally equal to the system pressure or varied according to a pre-programmed profile if the mandrel 40 needs to be oscillated during the bending operation. The action of the pressure die 24 minimizes stretching or thinning of the outer wall of the tube 14 and the mandrel 42 prevents inward collapsing of the tube 14 in response to the bending forces.

Figure 4:
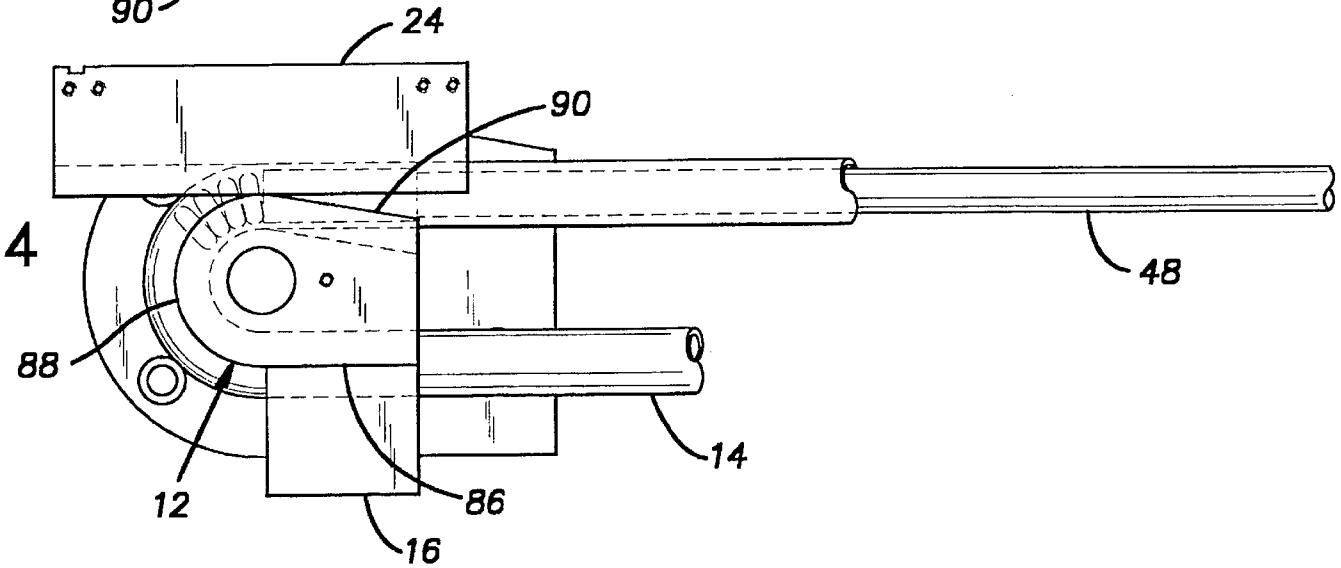
FIG. 4 is a is a top plan view illustrating the interrelationship between the bend die, the clamp die, the pressure die, and the mandrel at the completion of a 180 degree bend.

As shown in FIG. 4, after rotating the bend die 12 about 180 degrees, the mandrel 42 and the pressure die 24 are located adjacent a rear tangent or end section 90 of the bend die 12. At the completion of the bend, the mandrel 42 is retracted in a direction away from the bend die 12 at a pressure which is preferably higher than the system pressure. The mandrel 40 is typically difficult to extract because the mandrel 40 is within the tube 14 (the tube 14 having been slightly formed around the mandrel head 44 and/or balls 46). Once retraction of the mandrel is completed, the clamp die is released and returned with the bend die 12 to their initial position, at which time the same tube or a new tube can be positioned for another bend.

Although particular embodiments of the invention have been described in detail, it will be understood that the invention is not limited correspondingly in scope, but includes all changes and modifications coming within the spirit and terms of the claims appended hereto.

What is claimed is:

1. A mandrel extractor for a tube bending machine having a rotatable bend die around which a tube is bent, said mandrel extractor system comprising:

a flexible mandrel insertable into the tube to a part of the tube which is bent;

a mandrel rod fixed to a rear end of said flexible mandrel;

a hydraulic cylinder with a piston connected to said mandrel rod and ports on opposite sides of said piston; and an electro-hydraulic control system for driving said cylinder in accordance with pre-programmed parameters, said electro-hydraulic control system including a hydraulic pump for providing hydraulic fluid to said cylinder, a directional valve connected to said ports for feeding the hydraulic fluid from said hydraulic pump to each of said ports, a proportional pressure control valve connecting said hydraulic pump to said directional control valve for varying pressure of the hydraulic fluid, and a controller in electrical communication with said proportional pressure control valve for providing control signals to set pressure of the hydraulic fluid to preselected levels, wherein said hydraulic cylinder may drive said mandrel with a choice of at least two pressures in one direction.

2. The tube bending machine according to claim 1, wherein data pre-programmed into said controller includes a plurality of pressure settings for said proportional pressure control valve.

3. The tube bending machine according to claim 1, wherein said mandrel is a flexible mandrel.

4. The mandrel extractor system according to claim 1, wherein said hydraulic cylinder drives said mandrel with at least two pressures in an advancing direction.

5. The tube bending machine according to claim 2, wherein said plurality of pressure setting includes a first pressure, a second pressure higher than said first pressure and generally equal to a system pressure of said tube bending machine, and a third pressure higher than said second pressure.

6. The tube bending machine according to claim 2, wherein each of said pressure settings are input as a percentage of maximum pressure of said electro-hydraulic system.

7. A tube bending machine for placing at least one bend in a tube, said tube bending machine comprising:

a rotatable bend die about which the tube is bent;

a mandrel insertable into the tube adjacent the bend;

a mandrel rod fixed to a rear end of the mandrel; and a mandrel extractor system for linearly advancing and retracting said mandrel into a portion of the tube which is bent including a linear actuator connected to said mandrel rod and an electro-hydraulic control system for driving said linear actuator at variable pressures to provide said mandrel with a choice of at least two pressures in one direction.

8. The tube bending machine according to claim 7, wherein said linear actuator includes a hydraulic cylinder with a piston connected to said mandrel rod and ports on opposite sides of said piston, and said electro-hydraulic control system includes a hydraulic pump for providing hydraulic fluid to said cylinder, a directional valve connected to said ports for selectively feeding the hydraulic fluid from said hydraulic pump to each of said ports of said cylinder, a proportional pressure control valve connecting said hydraulic pump to said flow directional valve for varying pressure of the hydraulic fluid, and a controller in electrical communication with said proportional pressure control valve for providing control signals to set pressure of the hydraulic fluid.

9. The tube bending machine according to claim 7, wherein said mandrel is a flexible mandrel.

10. The tube bending machine according to claim 7, wherein said mandrel is provided with at least two pressures in an advancing direction.

11. The tube bending machine according to claim 8, wherein data to be pre-programmed into said controller includes a plurality of pressure settings for said proportional pressure control valve.

12. The tube bending machine according to claim 7, wherein said controller includes a plurality of pressure settings including a first pressure, a second pressure higher than said first pressure for moving the mandrel in one direction, and a third pressure higher than said second pressure for moving the mandrel in another direction.

13. The tube bending machine according to claim 11, wherein each of said pressure settings are input as a percentage of maximum pressure of said electro-hydraulic system.

14. A method for bending a tube comprising the steps of:

(a) moving a mandrel forward to a tangent point of said bend die with a mandrel extractor operating at a first pressure;

(b) loading the tube over a mandrel;

(c) clamping said tube between a clamp die and a bend die;

(d) increasing said mandrel extractor to a second pressure, higher than said first pressure, after moving said mandrel to said tangent point;

(e) rotating said clamp and bend dies through said desired angle to form a bend, the mandrel being in part of the bend; and (f) extracting said mandrel from said tube.

15. The method according to claim 14, wherein said second pressure is generally equal to a constant system pressure of said tube bending machine.

16. The method according to claim 14, wherein said operating pressure of said mandrel extractor is increased to a third pressure, higher than said second pressure, for the step of extracting said mandrel from said tube.

17. The method according to claim 14, further comprising the step of varying the pressure of said mandrel extractor during the step of rotating said clamp and bend dies.

18. The method according to claim 14, wherein said first pressure is generally equal to a minimum force required to move the mandrel.

19. The method according to claim 14, further comprising the step of automatically stopping forward movement of the mandrel to the tangent point if the mandrel has not fully advanced within a predetermined time limit.

20. The method according to claim 15, wherein said operating pressure of said mandrel extractor is increased to a third pressure, higher than said second pressure, for the step of extracting said mandrel from said tube.

* * * * *

UNITED STATES PATENT AND TRADEMARK OFFICE

CERTIFICATE OF CORRECTION

PATENT NO. : 5,632,176

DATED : May 27, 1997

INVENTOR(S) : Ajay K. Bhandari

It is certified that error appears in the above-indentified patent and that said Letters Patent is hereby corrected as shown below:

On the title page: Item [56]

under "U.S. Patent Documents," please insert the following:

--3,696,481 10/1972 Schmidt-- and
--4,805,439 2/1989 Kobayashi et al.--.

Signed and Sealed this

Fourteenth Day of October, 1997

*Attest:*

Bruce Lehman

BRUCE LEHMAN

*Attesting Officer*

*Commissioner of Patents and Trademarks*